US006530154B2

(12) United States Patent
Towle

(10) Patent No.: US 6,530,154 B2
(45) Date of Patent: Mar. 11, 2003

(54) METHOD TO DETECT DEVIATIONS FROM A WELLPLAN WHILE DRILLING IN THE PRESENCE OF MAGNETIC INTERFERENCE

(75) Inventor: James N. Towle, Seattle, WA (US)

(73) Assignee: Scientific Drilling International, Houston, TX (US)

( * ) Notice: Subject to any disclaimer, the term of this patent is extended or adjusted under 35 U.S.C. 154(b) by 0 days.

(21) Appl. No.: 09/907,866

(22) Filed: Jul. 19, 2001

(65) Prior Publication Data

US 2003/0014873 A1 Jan. 23, 2003

(51) Int. Cl.[7] ..... E21B 47/022

(52) U.S. Cl. ..... 33/304; 33/1 H; 33/313; 73/152.43; 175/24; 324/346

(58) Field of Search ..... 33/304, 1 H, 302, 33/303, 313, 356; 73/152.43; 324/346; 175/24, 40

(56) References Cited

U.S. PATENT DOCUMENTS

| | | | | |
|---|---|---|---|---|
| 3,725,777 A | | 4/1973 | Robinson et al. | |
| 4,072,200 A | | 2/1978 | Morris et al. | |
| 4,458,767 A | | 7/1984 | Hoehn, Jr. | |
| 4,700,142 A | * | 10/1987 | Kuckes | 33/304 |
| 5,084,678 A | * | 1/1992 | Hutin | 324/346 |
| 5,131,477 A | * | 7/1992 | Stagg et al. | 175/40 |
| 5,155,916 A | | 10/1992 | Engebretson | |
| 5,230,387 A | | 7/1993 | Waters et al. | |
| 5,398,421 A | | 3/1995 | Nicolle et al. | |
| 5,435,069 A | | 7/1995 | Nicholson | |
| 5,452,518 A | | 9/1995 | DiPersio | |
| 5,485,089 A | * | 1/1996 | Kuckes | 324/346 |
| 5,512,830 A | | 4/1996 | Kuckes | |
| 5,564,193 A | | 10/1996 | Brooks | |
| 5,589,775 A | * | 12/1996 | Kuckes | 324/346 |
| 6,321,456 B1 | * | 11/2001 | McElhinnney | 62/173 |

* cited by examiner

*Primary Examiner*—Christopher W. Fulton
(74) *Attorney, Agent, or Firm*—William W. Haefliger

(57) ABSTRACT

A method for drilling a wellbore to assure the avoidance of a substantially adjacent known magnetic source comprising the steps of obtaining survey data for the path or trajectory of a known magnetic source; preparing a wellplan comprising a path or trajectory for a second wellbore to be drilled, from the survey data and the wellplan, computing expected values of one or more parameters of the magnetic field to be encountered along a second wellbore during drilling operations, in association with drilling a second wellbore, measuring components of a magnetic field encountered and computing one or more magnetic field parameters at a series of survey points along the wellbore path or trajectory; and determining if measured values differ systematically from expected values, thereby indicating a deviation from the planned wellpath.

16 Claims, 4 Drawing Sheets

METHOD TO DETECT DEVIATIONS FROM A WELLPLAN WHILE DRILLING IN THE PRESENCE OF MAGNETIC INTERFERENCE

BACKGROUND OF THE INVENTION

This invention relates generally to method and apparatus for drilling a wellbore in a sub-surface formation, to enable avoidance of physical interference with an existing magnetic source, or magnetically responsive source such as well casing in the formation; more particularly, it concerns comparison and/or use of information derived from an existing magnetic source in the formation, from a wellbore plan, and from an actual wellbore being drilled, to enable such avoidance.

In the prior art, effort has been directed to the reduction of systematic magnetic survey inaccuracies. Corrections for drillstring interference and other systematic errors are disclosed by Engebretson et al. in U.S. Pat. No. 5,155,916. Similarly, U.S. Pat. No. 5,452,518 discloses a method to reduce along axis interference. U.S. Pat. No. 5,564,193 discloses a method wherein the transverse, as well as axial component of drillstring interference is determined by a series of magnetic measurements, with the drillstring displaced angularly about its axis. U.S. Pat. No. 5,398,421 discloses a method whereby a sequence of longitudinally spaced shots, having differing rotation angles along the wellbore are combined, in a regression analysis to determine a local perturbation in the earth magnetic field associated with the drillstring.

U.S. Pat. No. 5,435,069 to Nicholson discloses a method whereby multiple vector magnetic and gravity measurements along a curved wellpath may be used to determine a perturbating magnetic field associated with the drilling or logging string.

The prior art also discloses methods to determine the location and attitude of a source of magnetic interference U.S. Pat. No. 3,725,777 describes a method to determine the earth's field from a magnetic compass and total field measurements, and then calculate the deviations, due to the external source of magnetic interference. The magnetic field of a long cylinder is then fitted to the magnetic deviations in a least-squares sense. The method requires that the magnetic field measurements be taken on a straight wellpath.

U.S. Pat. No. 4,458,767 describes a method by which the position of a nearby well is determined from the magnetic field produced by magnetized sections of casing. There is no description of a method by which the earth field is removed from the magnetic measurements.

European Patent Application GB9409550 discloses a graphical method for locating the axis of a cylindrical magnetic source from borehole magnetic field measurements acquired at intervals along a straight wellbore.

U.S. Pat. No. 5,512,830 described a method whereby the position of a nearby magnetic well casing is determined by approximating the static magnetic field of the casing by a series of mathematical functions distributed sinusoidally along the casing. In an earlier paper (Jones et al.), a method was described whereby the static magnetic field of a casing was approximated by an exponential function.

In the above references, no method is described whereby the earth field is determined along a wellpath having unknown and possibly changing azimuth, so as to determine local variations in the magnetic field vector along the wellpath.

U.S. Pat. Nos. 5,230,387 and 4,072,200 disclose a method whereby the magnetic field gradient is measured along a wellbore for the purpose of locating a nearby magnetic object. The gradient is calculated by measuring the difference in magnetic field between two closely spaced measurements; and because the earth field is constant over a short distance, the effect of the earth field is removed from the gradient measurement. The location and attitude of source external to the drillstring can then be determined by comparison with theoretical models of the magnetic field gradient produced by the external source.

The above efforts to improve magnetic surveys and locate sources of magnetic interference external to the wellbore evidence the need for improvements, which are now provided by the present invention.

The specific objective of the present invention is to provide a simple and inexpensive method to assure avoidance of a substantially adjacent known magnetic source using measurements made during a normal measure-while-drilling operation.

The need for the present invention is clear from the increase in closely spaced or "in-fill" drilled wellbores to maximize production from existing offshore platforms. In-fill drilling is also used to place wells so as to obtain production from areas of a reservoir that may have been by-passed during earlier operation.

SUMMARY OF THE INVENTION

It is a major object to provide a method or methods, as well as apparatus, to meet need for the invention as referred to, and as will be referred to herein.

The present invention provides an improvement in the art of drilling closely spaced wells. In the prior art, collision between closely spaced wells is avoided by carefully estimating the errors associated with wellborn surveys in planning new wells, with hope that the probability of collision due to inaccurate survey data below an acceptable threshold. It is typical however, that survey errors prevent the drilling of wells with separations less than 25 feet. Because survey errors are cumulative, deep wells cannot typically be drilled to separations less than 100 feet, to avoid risk of collision.

The present invention permits drilling of wells to separations limited only by the advance notice required by the drilling apparatus to steer away and avoid collision with the proximate well.

Basically, the method of the invention is employed in the drilling of a wellbore in a formation to enable avoidance of an existent magnetic source in the formation, and includes the steps:

a) obtaining first information indications of the existing path or trajectory of the existent magnetic source, in the underground formation, b) obtaining second information indications of a wellplan that includes a planned path or trajectory for a wellbore to be drilled, avoiding collision with the path or trajectory of the existent magnetic source, c) using the first and second information indications to derive expected values corresponding to one or more parameters of the magnetic field to be encountered along the planned wellbore to be drilled, d) measuring existing magnetic field components actually encountered along the wellbore during drilling, and deriving therefrom actual values of one or more magnetic field parameters that correspond to the expected values, e) and comparing the actual values with the expected values, to determine the existence of deviation of the drilled wellpath from the planned wellpath.

In one basic embodiment of the invention, a magnetic sensor package, usually the MWD (measurement while drilling) survey sensors, is deployed in the bottom hole assembly (BHA) of the drillstring. In addition to making the conventional MWD measurements, the MWD sensor package is used to compare the measured total magnetic field magnitude with an expected value, computed from a magnetic model of the existent casing string.

In a region remote from any wellbore casings or other sources of interference, the magnetic sensor package measures the components of the earth's magnetic field, and from these measurements the magnetic azimuth of the axis of the drillstring can be determined.

In the proximity of an existing wellbore casing, the remanent and induced magnetic fields of the casing string produce a magnetic field along the wellbore path of the magnetic sensor package. This additional magnetic field adds vectorially to the earth's magnetic field in a complex fashion that depends on the relative position and attitudes of casing string and wellpath.

In a basic embodiment of the present invention, a calculation is made of the maximum expected total magnetic field along the wellpath by means of a magnetic model representing the maximum likely magnetic pole strengths on the casing string, the known path of the casing string, and the planned or measured path of the sensor package.

The measured total magnetic field is then compared with the maximum expected values for the known casing string locations and the planned or measured wellpath. Any differences indicate a deviation from the planned wellpath relative to the casing survey positions.

At least two situations may arise wherein the measured total magnetic field differs from the expected values. First, the casing survey may for a number of reasons, be inaccurate. The result may be that the planned wellpath is closer than desired to the existent casing, for reasons of safety. Second, the wellpath itself may be inaccurately surveyed due to undetected errors in the accuracy of measured azimuth, inclination, or surface location. In either case, the difference between the measured and expected values of total magnetic field is an indicator of deviation from the planned wellpath or the assumed position of the casing string derived from previous survey data.

In another preferred embodiment a more sensitive parameter, the vector distance between the measured and expected total magnetic vectors, replaces the Btotal parameter, where B represents magnetic field strength.

These and other objects and advantages of the invention, as well as the details of an illustrative embodiment, will be more fully understood from the following specification and drawings, in which:

DRAWING DESCRIPTION

Figure 3:
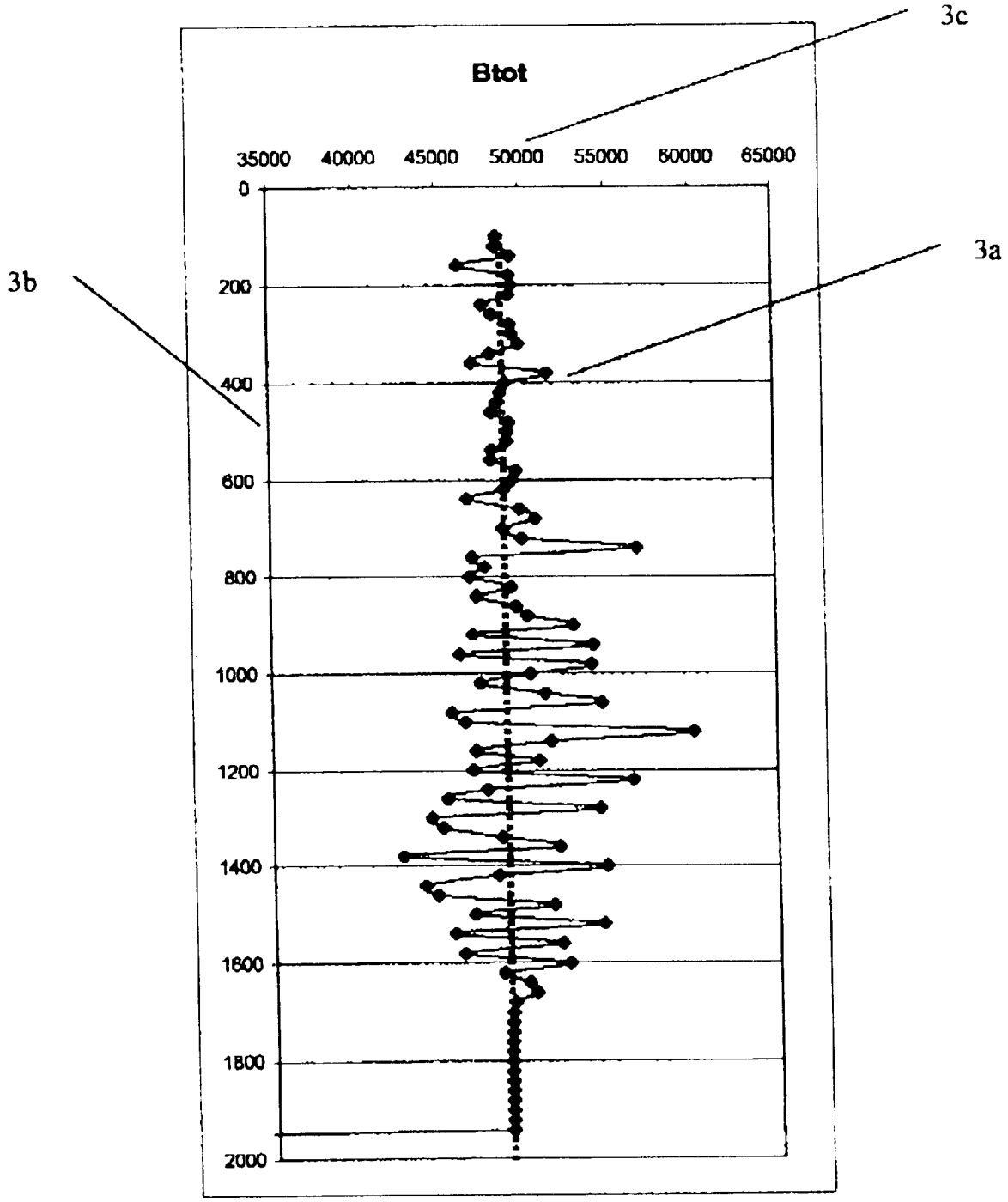
Figure 4:
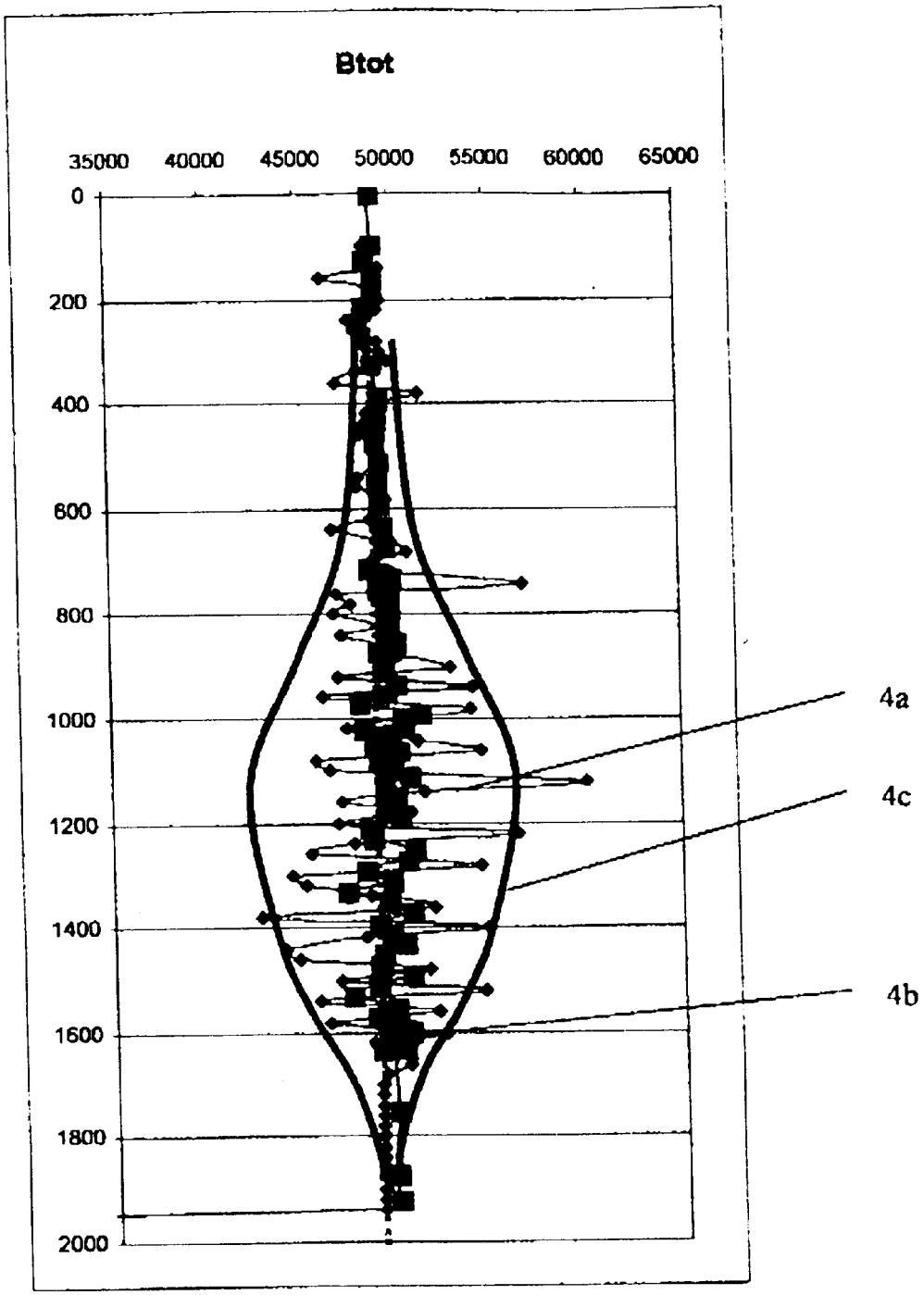

FIG. 3 is a readout diagram that shows the expected variations in the total magnetic field along the wellbore, caused by remanant magnetization on the previously installed casing string, as measured by a tri-axial magnetic sensor package in the wellbore drillstring; and FIG. 4 is a readout diagram that shows actual measured variations in total magnetic field, as the package proceeds near the casing string.

DETAILED DESCRIPTION

The present invention provides an improvement in the art of drilling closely spaced wells. In the prior art, collision between closely spaced wells is avoided by carefully estimating the errors associated with wellbore surveys in planning new wells, with hope that the probability of collision due to inaccurate survey data below an acceptable threshold. It is typical however, that survey errors are such as to preclude or prevent the drilling of wells with separations less than 25 feet. Because survey errors are cumulative, deep wells cannot typically be drilled to separations less than 100 feet, to avoid risk of collision.

The present invention overcomes such difficult and restrictions by enabling or permitting drilling of wells to separations limited only by the advance notice required by the drilling apparatus to steer away and avoid collision with the proximate well.

Figure 1:
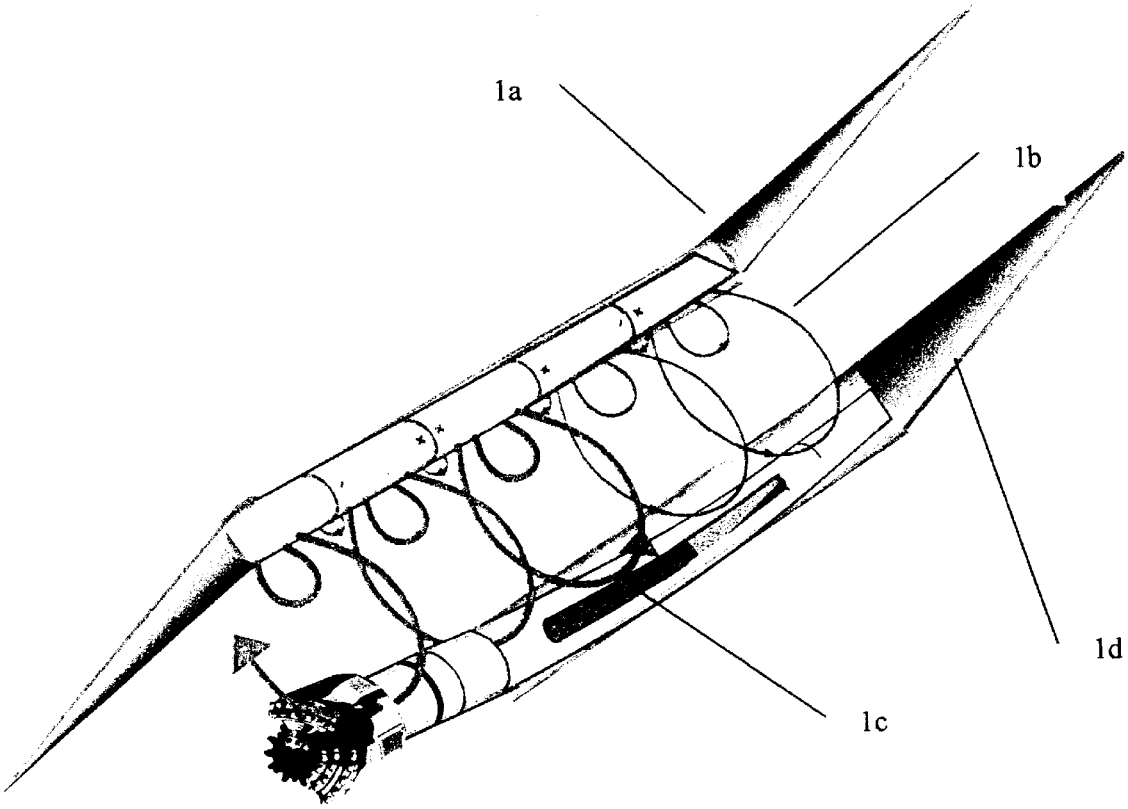
FIG. 1 is a perspective view that shows a drillstring extending close to a well casing string in an underground formation, the wellbore string carrying a sensor package, and with schematic representation of remanant magnetization on the casing string.

Referring first to FIG. 1, proximity to a nearby wellbore casing 1*a* in an underground formation 10 is detected for example by measuring the 3-rectangular component magnetic field 1*b* at a sensor package 1*c* in the drillstring 1*d* of the well being drilled. Instrumentation to effect such measurement is known. A parameter of the measured field is then compared with a pre-calculated value or set of expected values for the same parameter, (for example, field strength in the three directions x, y and z, of the rectangular system) and the result is used to steer the drillstring.

Figure 2:
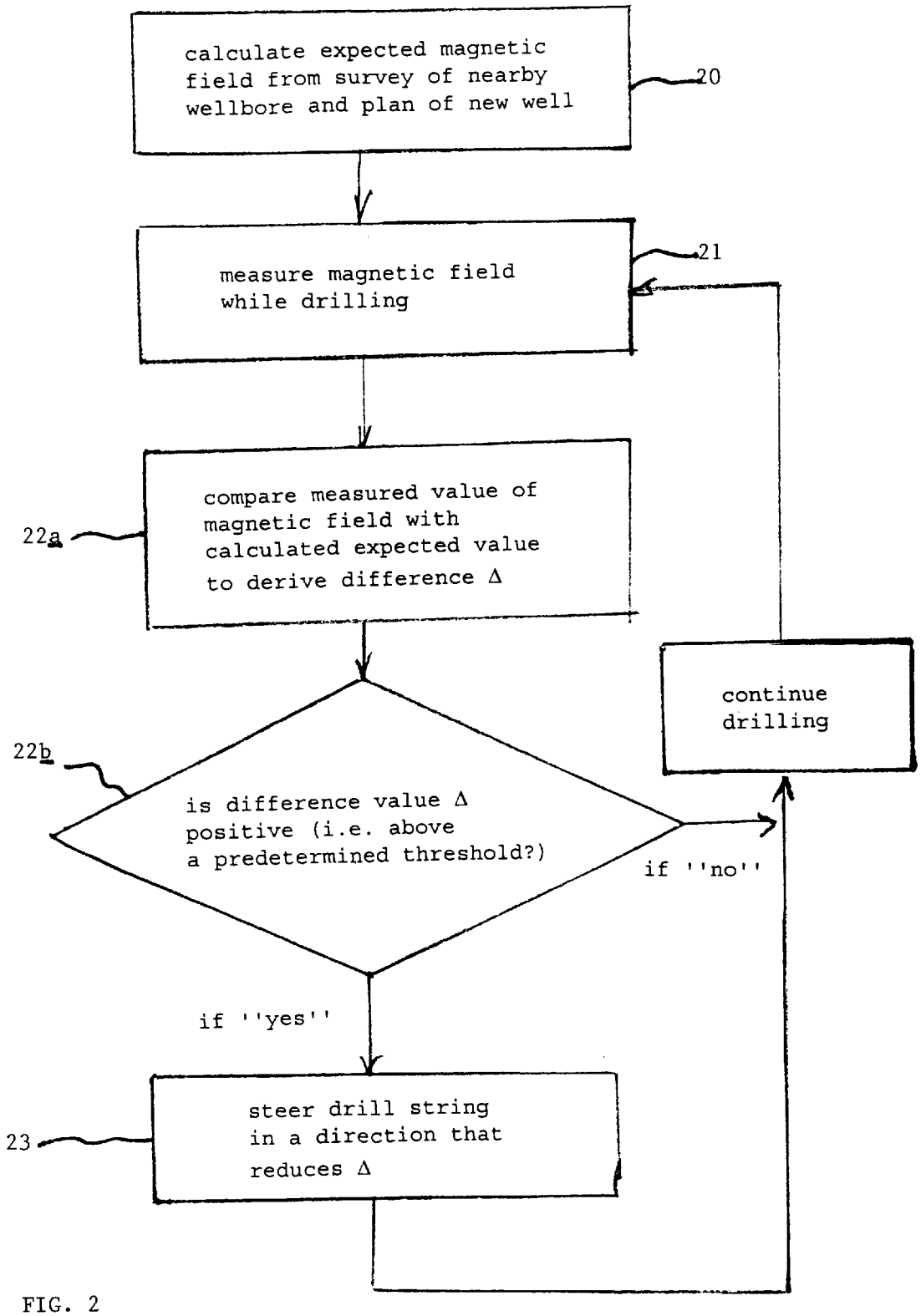
FIG. 2 is a block diagram showing steps of the method of the invention.

The method of this invention includes steps 20–23 as shown in the diagram of FIG. 2.

Step 20 corresponds to obtaining survey data for the path or trajectory of the known magnetic source, preparing a wellplan comprising a path or trajectory for a second wellbore to be drilled, from said survey data and said wellplan, and computing expected values of one or more parameters of the magnetic field to be encountered along the path of the second wellbore during drilling operations.

Step 21 corresponds to measuring while drilling said second wellbore, components of said magnetic field encountered and computing the one or more magnetic field parameters at a series of survey points along said wellbore path or trajectory.

Steps 22*a* and 22*b* correspond to comparing the measured values of such x, y, z components with the computed expected values, and determining if the measured values differ systematically from such expected values, thereby indicating a deviation from the planned wellpath.

Step 23 corresponds to steering the drilling of the second wellbore in a direction that reduces the difference value Δ yielded by the comparison. In this regard drillstring steering per se is well know in the art.

The blocks shown in FIG. 2 may also be regarded or considered as means elements for performing the indicated steps or functions.

Examples of the expected total magnetic field and the measured magnetic field from a drilling operation, employing the methods of the invention, are shown in FIG. 3 and FIG. 4 respectively. In FIG. 3 the expected total magnetic field 3*a* is plotted, as during drilling, with the vertical axis values representing measured depth 3*b* in the wellbore in feet, and the horizontal axis values of 3*a* representing total magnetic field B strength values in nanoTeslas 3*c*. In FIG. 4 the expected values of total magnetic field magnitude 4*a* are plotted with the corresponding measured values 4*b*.

In one embodiment of the invention, measured total magnetic field magnitude values on a plot are visually compared point by point with the expected values. Proximity to the existing casing is indicated by the measured values lying (or systematically lying) outside an averaged envelope 4*c* (for example a threshold) of expected values. Such "outside values" appear at 4*d*.

Thus, the computed said expected value, is the total magnetic field and the computation comprises computing the quantity $$B_{total(meas)}=\text{sqrt}[B_{x(meas)}^2+B_{y(meas)}^2+B_{z(meas)}^2]$$

In another preferred embodiment the distance parameter between the measured total magnetic field vector and the reference (earth) magnetic field vector is computed as $$\text{delta}B=\text{sqrt}[(B_{total(ref)}-B_{total(meas)})^2+(B_{total(ref)}*(Dip_{(ref)}-Dip_{(meas)}))^2]$$

where B is defined as magnetic field strength deltaB is defined as the computed expected value Dip is defined as the angle between the magnetic field vector and the horizontal plane.

$Dip_{(ref)}$ is defined as the earth field reference value of Dip, and $Dip_{(meas)}$ is defined as measured value of Dip.

* is defined as the multiplication sign.

This parameter deltaB measures the interference in the vertical plane of the local earth's magnetic field and is consequently independent of latitude and tool inclination. As such it is a better indicator of interference than Btotal which measures only the interference in the direction of the local earth magnetic field. Parameter Btotal has been proposed as an MWD acceptance parameter useful to the drilling industry.

In another embodiment of the invention, the expected value of the measured azimuth along the wellbore is calculated prior to drilling operations. In a further embodiment of the invention, when proximity is detected, magneto static ranging or other ranging methods are used to determine the direction to the interference casing string (in a first wellbore) to enable directing of the steering correction necessary to avoid collision.

I claim:

1. A method for drilling a wellbore to assure the avoidance of a substantially adjacent known magnetic source comprising the steps of:

a) obtaining survey data for the path or trajectory of said known magnetic source, b) preparing a wellplan comprising a path or trajectory for a second wellbore to be drilled, c) from said survey data and said wellplan, computing expected values of one or more parameters of the magnetic field to be encountered along said second wellbore during drilling operations, d) thereafter drilling said second wellbore, and measuring components of the magnetic field encountered and computing the said one or more magnetic field parameters at a series of survey points along said wellbore path or trajectory, e) determining if said measured values differ systematically from said expected values, thereby indicating a deviation from the planned wellpath.

2. The method of claim 1 wherein said known magnetic source is a wellbore casing.

3. The method of claim 2 wherein one said computed said expected value is the total magnetic field and the computation comprises computing the quantity $$B_{total(meas)}=\text{sqrt}[B_{x(meas)}^2+B_{y(meas)}^2+B_{z(meas)}^2].$$

4. The method of claim 2 wherein one said computed expected value is deltaB and the computation comprises computing the quantity $$\text{delta}B=\text{sqrt}[(B_{total(ref)}-B_{total(meas)})^2+(B_{total(ref)}*(Dip_{(ref)}-Dip_{(meas)}))^2].$$

5. The method of claim 1 wherein said determination of systematic difference between expected values and measured values comprises visually comparing said expected value of said parameter with said measured value of said parameter.

6. The method of claim 1 wherein, the calculated Btotals in an upper section of the second wellbore where the spacing of the first and second wellbore is well known are "matched" to the measured Btotals so as to reduce the uncertainty in the expected values of magnetic azimuth, and then proceeding in a lower section of the second wellbore to use the method as described, where B=magnetic value.

7. The method of claim 1 wherein said second wellbore has associated casing that has been pre-magnetized in a pattern to provide optimal detection characteristics.

8. The method of claim 7 wherein said pattern comprises alternating the sense of magnetization of successive casing sections, so as to provide alternating pairs of magnetic poles of same sign at wellbore casing joints.

9. A method for determining the effects of magnetic interference on measured magnetic azimuth comprising the steps of:

a) obtaining survey data for the path or trajectory of a known magnetic source associated with a first wellbore, b) preparing a wellplan comprising a path or trajectory for a second wellbore to be drilled, c) from said survey data and said wellplan, computing expected values of magnetic azimuth along said wellplan, and d) comparing expected values of said magnetic azimuth with values of magnetic azimuth measured during wellbore drilling.

10. The method of drilling a wellbore in a formation to enable avoidance of an existent magnetic source in the formation, that includes:

a) obtaining first information indications of the existing path or trajectory of the existent magnetic source, in the underground formation, b) obtaining second information indications of a wellplan that includes a planned path or trajectory for a wellbore to be drilled, avoiding collision with the path or trajectory of the existent magnetic source, c) using said first and second information indications to derive expected values corresponding to one or more parameters of the magnetic field to be encountered along the planned wellbore to be drilled, d) and thereafter drilling said planned wellbore and measuring existing magnet field components actually encountered along the wellbore during drilling, and deriving therefrom actual values of one or more magnetic field parameters that correspond to said expected values, at a series of survey locations along said wellbore, e) and comparing said actual values with said expected values to determine the existence of deviation of the drilled wellpath from the planned wellpath.

11. The method of claim 10 including steering the direction of drilling of the well in response to said comparing.

12. The method of claim 11 wherein if said actual value exceeds said expected value, the direction of drilling is steered to reduce said actual value.

13. The method of claim 11 wherein if said actual value does not exceed said expected value the direction of drilling is continued without substantial directional change.

14. The method of claim 10 wherein said existent magnetic source is at least one of the following:

i) wellbore casing, ii) well drill pipe, iii) well tubing.

15. The method of claim 10 includes causing drilling of the wellbore to be drilled to approach the existent magnetic source at a deviation distance between 25 and 100 feet.

16. Apparatus for enabling avoidance of a wellbore being drilled with an existent magnetic source, in an underground formation, that includes a) means for obtaining first information indications of the existing path or trajectory of the existent magnetic source, in the underground formation, b) means for obtaining second information indications of a wellplan that includes a planned path or trajectory for a wellbore to be drilled, avoiding collision with the path or trajectory of the existent magnetic source, c) means for using said first and second information indications to derive expected values corresponding to one or more parameters of the magnetic field to be encountered along the planned wellbore to be drilled, d) means for measuring existing magnetic field components actually encountered along the planned wellbore during drilling after said wellbore planning, and deriving therefrom actual values of one or more magnetic field parameters that correspond to said expected values, at a series of survey locations along said wellbore, e) and means for comparing said actual values with said expected values to determine the existence of deviation of the drilled wellpath from the planned wellpath.

* * * * *